US007760219B2

(12) United States Patent
Shirai et al.

(10) Patent No.: US 7,760,219 B2
(45) Date of Patent: Jul. 20, 2010

(54) METHOD OF FORMING IMAGE BY THERMAL TRANSFER

(75) Inventors: Hideyuki Shirai, Minami-ashigara (JP); Junichiro Hosokawa, Minami-ashigara (JP); Yasufumi Nakai, Tokyo (JP); Hisato Nagase, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 12/360,344

(22) Filed: Jan. 27, 2009

(65) Prior Publication Data

US 2009/0195633 A1 Aug. 6, 2009

(30) Foreign Application Priority Data

Jan. 28, 2008 (JP) ..... 2008-016776

(51) Int. Cl.
*B41J 2/325* (2006.01)
*B41M 5/382* (2006.01)

(52) U.S. Cl. ..... 347/171

(58) Field of Classification Search ..... 347/171, 347/217, 221, 224; 400/120.01
See application file for complete search history.

(56) References Cited

U.S. PATENT DOCUMENTS

| | | | | |
|---|---|---|---|---|
| 2003/0232271 | A1 | 12/2003 | Yamamoto | |
| 2008/0020931 | A1 | 1/2008 | Irita | |
| 2009/0165938 | A1* | 7/2009 | Muro et al. | 156/230 |
| 2009/0191364 | A1* | 7/2009 | Oguma et al. | 428/32.39 |
| 2009/0191365 | A1* | 7/2009 | Oguma et al. | 428/32.39 |
| 2009/0207228 | A1* | 8/2009 | Sakai et al. | 347/200 |

FOREIGN PATENT DOCUMENTS

| | | | |
|---|---|---|---|
| EP | 1974941 | A1 | 10/2008 |
| JP | 4-113889 | A | 4/1992 |
| JP | 5-32072 | A | 2/1993 |
| JP | 8-2123 | A | 1/1996 |
| JP | 03-54140 | A | 2/2003 |
| JP | 2006-88691 | A | 4/2006 |
| JP | 2006-264092 | A | 10/2006 |
| JP | 2007-237643 | A | 9/2007 |
| WO | 98/47718 | A1 | 10/1998 |
| WO | 2007/013649 | A1 | 2/2007 |

* cited by examiner

*Primary Examiner*—Huan H Tran
(74) *Attorney, Agent, or Firm*—Sughrue Mion, PLLC

(57) ABSTRACT

A method of forming an image, containing superposing a heat-sensitive transfer sheet on a heat-sensitive transfer image-receiving sheet, and applying thermal energy from a side of a heat-resistant lubricating layer described below of the heat-sensitive transfer sheet, to form a thermally transferred image, in which the heat-sensitive transfer sheet comprises a substrate, a thermal transfer layer containing a thermally transferable dye and a resin on one face of the substrate, and the heat-resistant lubricating layer on the other face of the substrate; the heat-sensitive transfer image-receiving sheet comprise a support, and a heat insulation layer and a receptor layer on the support in this order; the thermal transfer layer contains a polymer compound having fluorine atom-substituted aliphatic groups on its side chains; and the receptor layer contains a latex polymer having a glass transition temperature of from 20° C. to 60° C.

8 Claims, No Drawings

METHOD OF FORMING IMAGE BY THERMAL TRANSFER

FIELD OF THE INVENTION

The present invention relates to a method of forming an image by thermal transfer by using a heat-sensitive transfer sheet and a heat-sensitive transfer image-receiving sheet. In particular, the present invention relates to an image-forming method by thermal transfer to prevent image defects from causing under various environmental conditions, i.e., under a high-temperature high-humidity condition or a low-temperature low-humidity condition.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it enables direct visualization from digital data; it makes reproduction simple, and the like without treatment chemicals.

Among these methods, in a sublimation type thermal transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated, for example, by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

In recent years, because an acceleration of a printer can shorten user's waiting time in the case where print is conducted in a photo shop for user's advantage, high-speed printers in the sublimation-type thermal transfer recording system, which can provide a print in a short time, have been developed and commercialized one after another.

In wide spread use of the printers in the sublimation-type thermal transfer recording system, there is a demand for a printer providing prints with good image quality under various environmental conditions without depending on an installation site. That is, in order to satisfy user's needs, it is necessary to provide a print good in image quality and free from image defect, not only under the standard air-conditioned environmental condition of offices and shops at a temperature of 23° C. to 27° C. and a humidity of 50% to 70%, but also, for example; under a high-temperature high-humidity condition in summer (e.g., temperature: 35° C., humidity: 80%) and a low-temperature low-humidity condition in winter (e.g., temperature: 10° C., humidity: 20%).

In an image-forming method by thermal transfer, two materials, a heat-sensitive transfer sheet and a heat-sensitive transfer image-receiving sheet, are used. Recently, methods of using a latex, i.e., an aqueous resin dispersion, in the receptor layer of the heat-sensitive transfer image-receiving sheet; are proposed (see JP-A-8-2123 ("JP-A" means unexamined published Japanese patent application), JP-A-2006-88691 and JP-A-2006-264092), disclosing that the heat-sensitive transfer image-receiving sheets have a suitable sensitivity and have good printing characteristics free from white spots (white spots defect in solid image).

However, these heat-sensitive transfer image-receiving sheets give images at good quality under a standard condition (e.g., temperature: 25° C., humidity: 60%), but are not resistant enough to white spot-shape image defect (hereinafter, referred to as white spots defect) after printing under a low-temperature low-humidity condition (e.g., temperature: 10° C., humidity: 20%). Further, these sheets cause other problems of image defects such as a fusion of the heat-sensitive transfer sheet and the heat-sensitive transfer image-receiving sheet after printing or a generation of separation residue lines by a discontinuous separation of the heat-sensitive transfer sheet from the heat-sensitive transfer image-receiving sheet, under a high-temperature high-humidity condition (e.g., temperature: 35° C., humidity: 80%).

On the other hand, to prevent image defects caused by a fusion between the heat-sensitive transfer sheet and the heat-sensitive image-receiving transfer sheet, a method of adding a latex polymer having a resin characteristic of a low glass transition temperature (lower than 50° C.) and a latex polymer having a resin characteristic of a high glass transition temperature (50° C. or higher) to a receptor layer is proposed (see JP-A-2007-237643). However, it is not possible by the method to prevent image defects during printing generated under a high-temperature high-humidity condition sufficiently and a degree of the image defects is remarkably increased when images are printed in high speed printers commercialized recently.

For prevention of a fusion between the heat-sensitive transfer sheet and the heat-sensitive image-receiving transfer sheet, also proposed is a heat-sensitive transfer sheet containing a particular silicon compound effective in preventing the fusion with the heat-sensitive image-receiving transfer sheet (see JP-A-4-113889). However, the application does not mention the suitability of the heat-sensitive transfer image-receiving sheet prepared by using a latex polymer, and no consideration is given to the stability of the printed image quality against a fluctuation in an environmental condition.

These conventional heat-sensitive transfer materials (heat-sensitive transfer image-receiving sheets, heat-sensitive transfer sheets) have problems that, when a continuous temperature change is applied to, the dye is transferred in an amount greater than that expected in a highlighted region (corresponding to a low-temperature region), leading to increase a fluctuation in image density in the high-lighted region and thus, causing problems such as a color disappearance (whitening) and darkening of white image, for example; of white ground of wedding dress. To solve these problems, performing a gradation adjustment by LUT during printing is known, but such a gradation adjustment is still insufficient, and thus, there exists a need for a thermal transfer material good in gradation connection.

SUMMARY OF THE INVENTION

The present invention resides in a method of forming an image, comprising the steps of:

superposing a heat-sensitive transfer sheet on a heat-sensitive transfer image-receiving sheet, and applying thermal energy from a side of a heat-resistant lubricating layer described below of the heat-sensitive transfer sheet, to form a thermally transferred image, wherein the heat-sensitive transfer sheet comprises a substrate, a thermal transfer layer containing a thermally transferable dye and a resin on one face of the substrate, and the heat-resistant lubricating layer on the other face of the substrate, wherein the heat-sensitive transfer image-receiving sheet comprise a support, and at least one heat insulation layer and at least one receptor layer on the support in this order, wherein the thermal transfer layer contains a polymer compound having fluorine atom-substituted aliphatic groups on its side chains, and wherein the receptor layer contains a latex polymer having a glass transition temperature (Tg) of 20° C. or higher and 60° C. or lower.

Other and further features and advantages of the invention will appear more fully from the following description.

DETAILED DESCRIPTION OF THE INVENTION

According to the present invention, there is provided the following means:

(1) A method of forming an image, comprising the steps of:

superposing a heat-sensitive transfer sheet on a heat-sensitive transfer image-receiving sheet, and applying thermal energy from a side of a heat-resistant lubricating layer described below of the heat-sensitive transfer sheet, to form a thermally transferred image, wherein the heat-sensitive transfer sheet comprises a substrate, a thermal transfer layer containing a thermally transferable dye and a resin on one face of the substrate, and the heat-resistant lubricating layer on the other face of the substrate, wherein the heat-sensitive transfer image-receiving sheet comprise a support, and at least one heat insulation layer and at least one receptor layer on the support in this order, wherein the thermal transfer layer contains a polymer compound having fluorine atom-substituted aliphatic groups on its side chains, and wherein the receptor layer contains a latex polymer having a glass transition temperature (Tg) of 20° C. or higher and 60° C. or lower.

(2) The method of forming an image described in the above item (1), wherein the polymer compound having fluorine atom-substituted aliphatic groups on its side chains is nonionic.

(3) The method of forming an image described in the above item (1) or (2), wherein the polymer compound having fluorine atom-substituted aliphatic groups on its side chains is water-soluble.

(4) The method of forming an image described in any one of the above items (1) to (3), wherein the heat insulation layer contains hollow polymer particles.

(5) The method of forming an image described in any one of the above items (1) to (4), wherein the receptor layer contains a polymer compound having fluorine atom-substituted aliphatic groups on its side chains.

(6) The method of forming an image described in the above item (5), wherein the polymer compound having fluorine atom-substituted aliphatic groups on its side chains contained in the receptor layer is nonionic.

(7) The method of forming an image described in the above item (5) or (6), wherein the polymer compound having fluorine atom-substituted aliphatic groups on its side chains contained in the receptor layer is water-soluble.

(8) The method of forming an image described in any one of the above items (1) to (7), wherein the receptor layer contains water-soluble polymer particles.

The image-forming method of the present invention is explained in detail below.

First, the heat-sensitive transfer sheet for use in the present invention is explained in detail below.

The heat-sensitive transfer sheet for use in the present invention has a substrate and a thermal transfer layer containing a diffusion transfer dye (hereinafter, referred to as heat-sensitive thermal transfer layer or dye layer) formed thereon, and preferably has a transferable protective layer laminate formed on the same substrate, for forming a protective layer composed of a transparent resin on a thermally transferred image by thermal transfer and thus covering and protecting the image.

In the heat-sensitive transfer sheet in the present invention, preferably, thermal transfer layers in individual colors of yellow, magenta and cyan, and an optional thermal transfer layer in black are repeatedly provided onto a single substrate in area order in such a manner that the colors are divided from each other. An example of the thermal transfer layers is an embodiment wherein dye layers in individual colors of yellow, magenta and cyan are coated onto a single substrate in the longitudinal direction of the substrate in area order, correspondingly to the area of the recording surface of the above-mentioned heat-sensitive transfer image-receiving sheet, in such a manner that the colors are divided from each other. In addition to the three layers above, it may have a black thermal transfer layer. In addition, the heat-sensitive transfer sheet preferably has a mark indicating the start point of each of various colors allowing recognition by the printer used.

The heat-sensitive transfer sheet that can be used in the method of forming an image of the present invention contains a polymer compound having fluorine atom-substituted aliphatic groups on its side chains in the thermal transfer layer. The polymer compound having fluorine atom-substituted aliphatic groups on its side chains can be derived from a fluorine atom-substituted aliphatic compound (compound having a fluorine atom-substituted aliphatic group(s) on the side chain(s)) produced by a telomerization method (also referred to as a telomer method), or an oligomerization method (also referred to as an oligomer method). The fluorine atom-substituted aliphatic compound can be easily synthesized, for example, by a method described in JP-A-2002-90991.

The fluorine atom-substituted aliphatic group is an aliphatic group having at least one substituted fluorine atom (straight-chain, branched or cyclic aliphatic group), preferably an alkyl, alkenyl or cycloalkynyl group having 1 to 36 carbon atoms, more preferably an alkyl group having 1 to 36 carbon atoms (preferably 1 to 18 carbon atoms, more preferably 1 to 12 carbon atoms, furthermore preferably 1 to 10 carbon atoms, most preferably 4 to 8 carbon atoms) and the aliphatic group may be substituted additionally with a substituent other than the fluorine atom. Examples of the substituent include alkyl groups, aryl groups, heterocyclic groups, halogen atoms other than the fluorine atom, a hydroxyl group, alkoxy groups, aryloxy groups, alkylthio groups, arylthio groups, an amino group, alkylamino groups, arylamino groups, heterocyclic amino groups, acylamino groups, sulfone amino groups, carbamoyl groups, sulfamoyl groups, a cyano group, a nitro group, acyl groups, sulfonyl groups, ureido groups, and urethane groups.

In the present invention, the fluorine atom-substituted aliphatic group is most preferably a perfluoroalkyl group.

The polymer compound having fluorine atom-substituted aliphatic groups on the side chains is preferably a polymer or copolymer of a fluorine atom-substituted aliphatic group-containing monomer, and preferred examples of the monomers include acrylic acid derivatives (e.g., acrylic acids, acrylic esters, and acrylamides, preferably acrylic esters and acrylamides, more preferably acrylic esters) and methacrylic acid derivatives (e.g., methacrylic acids, methacrylic esters, and methacrylamides, preferably methacrylic esters and methacrylamides, more preferably methacrylic esters) each having an acyl moiety, alcohol moiety or amide moiety (a substituent bonding with the nitrogen atom) substituted with a fluorine atom-substituted aliphatic group; and acrylonitrile derivatives having a fluorine atom-substituted aliphatic group.

In the case where the polymer compound having fluorine atom-substituted aliphatic groups on the side chains is a copolymer with a fluorine atom-substituted aliphatic group-containing monomer, examples of the monomer used in combination include acrylates, methacrylates, acrylonitriles, acrylamides, methacrylamides, olefins, and styrenes. Among these, acrylates, methacrylates, acrylonitriles, acrylamides, and methacrylamides are preferable; acrylates and methacrylates are more preferable; and among them, those having a polyoxyalkylene (e.g., polyoxyethylene, polyoxypropylene) unit in the group substituted on the alcohol moiety or the amide nitrogen atom are preferable.

In the present invention, the polymer above is preferably a copolymer, which may be a binary copolymer or a ternary or higher copolymer.

As the polymers having a fluorine atom-substituted aliphatic group on its side chains, preferred are copolymers of a monomer having an aliphatic group substituted with a fluorine atom and (poly(oxyalkylene))acrylate and/or (poly(oxyalkylene))methacrylate. They may be random copolymers or block copolymers. Examples of the poly(oxyalkylene) group include poly(oxyethylene) group, poly(oxypropylene) group, and poly(oxybutylene) group. Further, the poly(oxyalkylene) group may be a unit having alkylene groups of chain lengths different from each other in the same chain, such as poly (block connector of oxyethylene, oxypropylene and oxyethylene) and poly(block connector of oxyethylene and oxypropylene). Further, the copolymer of a monomer having an aliphatic group substituted with a fluorine atom and (poly (oxyalkylene))acrylate (or methacrylate) is not limited to binary copolymers, but may be ternary or more multiple copolymers that can be produced by copolymerizing several different monomers such as monomers having two or more different substituted aliphatic groups substituted with a fluorine atom and two or more different kinds of (poly(oxyalkylene))acrylate (or methacrylate).

A weight-average molecular weight of the polymers having an aliphatic group substituted with a fluorine atom on its side chains ranges preferably from 5,000 to 100,000, more preferably from 8,000 to 50,000, and further preferably from 10,000 to 40,000.

Examples of the copolymers include copolymers of acrylate (or methacrylate) having a perfluorobutyl group (—$C_4F_9$) and (poly(oxyalkylene))acrylate (or methacrylate); copolymers of acrylate (or methacrylate) having a perfluorobutyl group, (poly(oxyethylene))acrylate (or methacrylate) and (poly(oxypropylene))acrylate (or methacrylate); copolymers of acrylate (or methacrylate) having a perfluorohexyl group (—$C_6F_{13}$) and (poly(oxyalkylene))acrylate (or methacrylate); copolymers of acrylate (or methacrylate) having a perfluorohexyl group, (poly(oxyethylene))acrylate (or methacrylate) and (poly(oxypropylene))acrylate (or methacrylate); copolymers of acrylate (or methacrylate) having a perfluorooctyl group (—$C_8F_{17}$) and (poly(oxyalkylene))acrylate (or methacrylate); and copolymers of acrylate (or methacrylate) having a perfluorooctyl group, (poly(oxyethylene))acrylate (or methacrylate) and (poly(oxypropylene))acrylate (or methacrylate).

Further, the polymers having an aliphatic group substituted with a fluorine atom on its side chains in the present invention are commercially available as a general name such as "perfluoroalkyl-containing oligomers". For example, the following products can be used.

As the products of Dainippon Ink & Chemicals Incorporated, there are Megafac F-470, Megafac F-471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K, Megafac F-178RM (each product name). As the products of Sumitomo 3 M Limited, there are Novec™ FC-4430 and FC-4432 (each product name).

The polymer compound having fluorine atom-substituted aliphatic groups on its side chains in the present invention is preferably nonionic (having no dissociable group in water such as sulfo group and carboxyl group), and more preferably, it is water-soluble to a certain degree. The phrase "water soluble to a certain degree" means that the polymer compound has solubility in pure water of 1% or more at 25° C. Specifically, the polymer is, for example, a polymer compound having a hydroxyl group(s) and/or the oxyalkylene group(s) described above. Favorable examples thereof include water-soluble compounds such as Megafac F-470, Megafac F-472SF, Megafac F-477, Megafac F-479, Megafac F-480SF, Megafac F-484, and Megafac F-486 (all trade names, manufactured by Dainippon Ink and Chemicals, Inc.).

In the present invention, the reason why the polymer compound having fluorine atom-substituted aliphatic groups on its side chains is preferably nonionic and soluble in water to a certain degree is not yet to be understood, but is assumed as follows.

The nonionic polymer compound having fluorine atom-substituted aliphatic groups on its side chains is suitably compatible with the dye and the binder in the thermal transfer layer and present stably in the layer during storage of the heat-sensitive transfer sheet. Thus, it is unlikely to cause troubles such as acceleration of dye bleeding out. On the other hand, the polymer compound, which is suitably compatible, because of its water solubility, with the receptor layer of the heat-sensitive transfer image-receiving sheet having a latex, seems to emanate into the interface between the heat-sensitive transfer sheet and the heat-sensitive transfer image-receiving sheet during image-formation under a high-temperature high-humidity condition, where it shows its releasing action effectively.

In particular, in the present invention, the polymer compound having fluorine atom-substituted aliphatic groups on its side chains seems to solve the problem of the conventional heat-sensitive transfer material that, when temperature change is applied continuously, the dye is transferred in an amount greater than that expected in the highlighted region (corresponding to low-temperature region) under the influence, for example, of the fluctuation in viscoelasticity by temperature change in the thermal transfer layer, leading to increased fluctuation in image density in the high-lighted region and thus, causing problems such as color disappearance (white spots) and darkening of white image, for example, of white image of wedding dress.

The polymer compound having fluorine atom-substituted aliphatic groups on its side chains may be added to any one of the thermal transfer layers in yellow, magenta, cyan, and black as needed, and may be contained in a single thermal transfer layer or in multiple thermal transfer layers. It is preferably added to all of the yellow, magenta and cyan thermal transfer layers.

The addition amount of the polymer compound having fluorine atom-substituted aliphatic groups on its side chains may be determined properly according to the kinds and amounts of the dye and the binder used, but the amount is preferably 0.01% to 20%, more preferably, 0.1% to 10%, and still more preferably 0.2% to 5%, with respect to the total solid content (mass) in the thermal transfer layer.

In the present invention, the thermal transfer layer generally contains a sublimation type dye and a binder. The thermal transfer layer may further contain waxes, silicone resins, and polymer particles and inorganic particles, in accordance with necessity.

Each dye in the thermal transfer layers is preferably contained in an amount of 20 to 80 mass % of the dye layer, preferably in that of 30 to 70 mass % thereof.

The coating of the dye layer is performed by an ordinary method such as roll coating, bar coating, gravure coating, or gravure reverse coating. The coating amount of the dye layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the dye layer is preferably from 0.1 to 2.0 μm, more preferably from 0.2 to 1.2 μm.

The dyes for use in the present invention are not particularly limited, so far as the dyes are able to diffuse by heat and able to be incorporated in a heat-sensitive transfer sheet, and able to transfer by heat from the heat-sensitive transfer sheet to an image-receiving sheet. The dyes that have been conventionally used for the heat-sensitive transfer sheet or known dyes can be used.

Preferable examples of the dyes include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrolazo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. These are not limited thereto. Further, dyes each having a different hue from each other as described above may be arbitrarily combined together.

Each of the dye layers may have a mono-layered structure or a multi-layered structure. In the case of the multi-layered structure, the individual layers constituting the thermal transfer layer may be the same or different in composition.

As the binder, various kinds of binder are known, and these can be used in the present invention. Examples thereof include acrylic resins such as polyacrylonitrile, polyacrylate, and polyacrylamide; polyvinyl acetal resins such as polyvinyl acetoacetal, and polyvinyl butyral; cellulose resins and modified cellulose resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate; other resins such as polyurethane resin, polyamide resin, polyester resin, polycarbonate resin, phenoxy resin, phenol resin, and epoxy resin; and various elastomers. The dye layer may be made of at least one resin selected from the above-mentioned group.

These may be used alone, or two or more thereof may be used in the form of a mixture or copolymer. These may be crosslinked with any one of various crosslinking agents.

The binder in the present invention is preferably cellulose resins or a polyvinyl acetal resins, more preferably polyvinyl acetal resins. Among them, a polyvinyl acetoacetal resin or polyvinyl butyral resin is preferably used in the present invention.

In the present invention, a transferable protective layer laminate is preferably formed in area order onto the heat-sensitive transfer sheet. The transferable protective layer laminate is used for forming a protective layer composed of a transparent resin on a thermally transferred image by thermal transfer and thus covering and protecting the image, thereby to improve durability such as scratch resistance, light-fastness, and resistance to weather. This laminate is effective for a case where the transferred dye is insufficient in image durabilities such as light resistance, scratch resistance, and chemical resistance in the state that the dye is naked in the surface of an image-receiving sheet.

The transferable protective layer laminate can be formed by forming, onto a substrate, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use a base film on which an easy adhesive layer has already been formed.

In the present invention, as a transferable protective layer-forming resin, preferred are resins that are excellent in scratch resistance, chemical resistance, transparency and hardness. Examples of the resin include polyester resins, acrylic resins, polystyrene resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins. These resins may be crosslinked with any one of various crosslinking agents.

In the heat-sensitive transfer sheet that is used in the present invention, it is preferred to dispose a back side layer on the surface (back side) of the substrate opposite to the thermal transfer layer coating side, namely on the same side as the surface with which a thermal head and the like contact. In addition, in the case of the protective layer transfer sheet, it is also preferred to dispose a back side layer on the surface (back side) of the substrate opposite to the transferable protective layer coating side, namely on the same side as the surface with which a thermal head and the like contact.

If the heat-sensitive transfer sheet is heated by a heating device such as a thermal head in the state such that the back side of the substrate of the heat-sensitive transfer sheet directly contacts with the heating device, heat seal is apt to occur. In addition, owing to a large friction between them, it is difficult to smoothly transfer the heat-sensitive transfer sheet at the time of image formation.

The back side layer is disposed so that the heat-sensitive transfer sheet enables to withstand heat energy from a thermal head. The back side layer prevents the heat seal, and enables a smooth travel action. In recent years, the necessity of the back side layer is becoming greater on account that the heat energy from a thermal head is increasing in association with speeding-up of the printer.

The back side layer is formed by coating a composition wherein additives such as a sliding agent, a release agent, a surfactant, inorganic particles, organic particles, and pigments are added to a binder. Further, an interlayer may be disposed between the back side layer and the substrate. As the interlayer, there has been known a layer containing inorganic fine particles and a water-soluble resin or a hydrophilic resin capable of emulsification.

A heat-sensitive transfer image-receiving sheet that can be used in the method of forming an image of the present invention will be described in detail hereinafter.

The heat-sensitive transfer image-receiving sheet has a support and at least one receptor layer containing a thermoplastic dye-receiving polymer formed thereon. The receptor layer may contain an ultraviolet absorbent, a releasing agent, a lubricant, an antioxidant, a preservative, a surfactant, and other additives. Between the support and the receptor layer may be formed an intermediate layer such as a heat insulating layer (porous layer), a gloss control layer, a white background adjusting layer, a charge control layer, an adhesive layer, or a primer layer. The heat-sensitive transfer image-receiving sheet preferably has at least one heat insulating layer between the support and the receptor layer.

The receptor layer and these intermediate layers are preferably formed by simultaneous multilayer coating, and a multiple number of these intermediate layers may be formed as needed.

A curling control layer, a writing layer, or a charge-control layer may be formed on the backside of the support. Each of these layers may be coated on the backside of the support by using a usual method such as a roll coating, a bar coating, a gravure coating, and a gravure reverse coating.

In the present invention, the heat-sensitive transfer image-receiving sheet contains a latex polymer having a glass transition temperature (Tg) of 20° C. or higher and 60° C. or lower in the receptor layer. The glass transition point of the latex polymer is preferably 25° C. or higher and 55° C. or lower, more preferably 25° C. or higher and 50° C. or lower.

In the present invention, use of a dyeable latex polymer is preferable. As a latex polymer, multiple latex polymers may be used. In such a case, at least one latex polymer is necessary to have a glass transition temperature (Tg) in the range above. Most preferably, all latex polymers contained have glass transition temperatures (Tgs) in the range above.

The latex polymer is generally a dispersion of fine particles of thermoplastic resin in a water-soluble dispersion medium. Examples of the thermoplastic resins used for the latex polymer in the present invention include polycarbonates, polyesters, polyacrylates, vinyl chloride copolymers, polyurethane, styrene-acrylonitrile copolymers, polycaprolactone and the like.

Among them, polycarbonates, polyesters, and vinyl chloride copolymers are preferable, polyesters and vinyl chloride copolymers are particularly preferable.

The polyester is prepared by condensation of a dicarboxylic acid derivative and a diol compound, and may include an aromatic ring and/or a saturated carbon ring as well as a water-soluble group for imparting dispersibility thereto.

Examples of the vinyl chloride copolymers include vinyl chloride-vinyl acetate copolymers, vinyl chloride-acrylate copolymers, vinyl chloride-methacrylate copolymers, vinyl chloride-vinyl acetate-acrylate copolymers, and vinyl chloride-acrylate-ethylene copolymers. As described above, the copolymer may be a binary copolymer or a ternary or higher copolymer, and the monomers may be distributed randomly or uniformly by block copolymerization.

The copolymer may contain a unit derived from an auxiliary monomer component such as vinylalcohol derivatives, maleic acid derivatives, and vinyl ether derivatives. The copolymer preferably contain vinyl chloride components in an amount of 50 mass % or more, and the unit derived from an auxiliary monomer component such as maleic acid derivative and vinyl ether derivative in an amount of 10 mass % or less.

The latex polymers may be used alone or as a mixture. The latex polymer may have a uniform structure or a core/shell structure, and in the latter case, the resins constituting the core and shell respectively may have different glass transition temperatures.

Examples of commercially available acrylate latexes include Nipol LX814 (Tg: 25° C.) and Nipol LX852X2 (Tg: 43° C.) (trade names, manufactured by ZEON CORPORATION) and others.

Examples of commercially available polyester latexes include VYLONAL MD-100 (Tg: 40° C.), VYLONAL MD-1400 (Tg: 20° C.), VYLONAL MD-1480 (Tg: 20° C.) and VYLONAL MD-1985 (Tg: 20° C.) (trade names, manufactured by Toyobo Co. Ltd.) and others.

Examples of commercially available vinyl chloride copolymers include VINYBLAN 276 (Tg: 33° C.) and VINYBLAN 609 (Tg: 46° C.) (trade names, manufactured by Nissin Chemical Industry Co., Ltd.), Sumielite 1320 (Tg: 30° C.) and Sumielite 1210 (Tg: 20° C.) (trade names, manufactured by Sumika Chemtex Company, Limited) and others.

The addition amount of the latex polymer (latex polymer solid content) is preferably 50 to 98 mass %, more preferably 70 to 95 mass %, with respect to all polymers in the receptor layer. The average particle diameter of the latex polymer is preferably 1 to 50,000 nm, more preferably 5 to 1,000 nm.

In the present invention, the heat insulation layer preferably contains hollow polymer particles.

The hollow polymer particles in the present invention are polymer particles having voids inside of the particles. The hollow polymer particles are preferably aqueous dispersion containing these hollow polymer particles. Examples of the hollow polymer particles include (1) non-foaming type hollow particles obtained in the following manner: a dispersion medium such as water is contained inside of a capsule wall formed of a polystyrene, acrylic resin, styrene/acrylic resin, or the like; and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

Of these, non-foaming hollow polymer particles of the foregoing (1) are preferred. If necessary, use can be made of a mixture of two or more kinds of polymer particles. Specific examples of the above (1) include Rohpake HP-1055, manufactured by Rohm and Haas Co.; SX866(B), manufactured by JSR Corporation; and Nippol MH5055, manufactured by ZEON CORPORATION (all trade names).

The average particle diameter (particle size) of the hollow polymer particles is preferably 0.1 to 5.0 μm, more preferably 0.2 to 3.0 μm, and particularly preferably 0.4 to 1.4 μm.

The hollow ratio (percentage of void) of the hollow polymer particles is preferably in the range of 20% to 70%, and particularly preferably 30% to 60%.

In the present invention, the particle size of the hollow polymer particles is calculated after measurement of the circle-equivalent diameter of the periphery of the particles under a transmission electron microscope. The average particle diameter is determined by measuring the circle-equivalent diameter of the periphery of at least 300 hollow polymer particles observed under the transmission electron microscope and obtaining the average thereof. The hollow ratio of the hollow polymer particles is calculated by the ratio of the volume of voids to the volume of a particle.

As for the resin properties of the hollow polymer particles for use in the heat-sensitive transfer image-receiving sheet in the present invention, the glass transition temperature (Tg) is preferably 70° C. or higher and 200° C. or lower, more preferably 90° C. or higher and 180° C. or lower. The hollow polymer particles are particularly preferably hollow latex polymer particles.

The heat-sensitive transfer image-receiving sheet, that can be used in the method of forming an image of the present invention, may contain a water-soluble polymer in the receptor layer and/or the heat insulation layer. Herein, the "water-soluble polymer" means a polymer which dissolves, in 100 g of water at 20° C., in an amount of preferably 0.05 g or more, more preferably 0.1 g or more, further preferably 0.5 g or more.

Examples of the water-soluble polymers that can be used in the heat-sensitive transfer image-receiving sheet in the present invention include carrageenans, pectins, dextrins, gelatins, caseins, carboxymethylcelluloses, hydroxyethylcelluloses, hydroxypropylcelluloses, polyvinylpyrrolidone, polyvinylpyrrolidone copolymers, polyvinylalcohol, polyethylene glycol, polypropylene glycol, and water-soluble polyesters. Among them, gelatin and polyvinylalcohol are preferable.

Gelatin having a molecular weight of 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

An ordinary crosslinking agent such as aldehyde-type crosslinking agent, N-methylol-type crosslinking agent, vinylsulfone-type crosslinking agent, or chlorotriazine-type crosslinking agent may be added to the gelatin above. Among the crosslinking agents above, vinylsulfone-type and chlorotriazine-type crosslinking agents are preferable, and typical examples thereof include bisvinylsulfonylmethylether, N,N'-ethylene-bis(vinylsulfonylacetamido)ethane, and 4,6-dichloro-2-hydroxy-1,3,5-triazine or the sodium salt thereof.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful. The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For a typical example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117 and PVA-117H; partially saponificated polyvinyl alcohol such as PVA-203, PVA-205, PVA-210 and PVA-220; and modified polyvinyl alcohols such as C-118, HL-12E, KL-118 and MP-203 (all trade names, manufactured by KURARAY CO., LTD.).

In the present invention, the receptor layer of the heat-sensitive transfer image-receiving sheet may contain the polymer compound having fluorine atom-substituted aliphatic groups on its side chains described above. In such a case, it may contain a polymer compound identical with or different in kind from the polymer compound having fluorine atom-substituted aliphatic groups on its side chains contained in the heat-sensitive transfer sheet, and both cases are preferable embodiments of the present invention. It may also contain, as a releasing agent, an ordinary polyethylene wax, a solid wax such as amide wax, a silicone oil, a phosphate ester compound, a fluorine-containing surfactant or a silicone-based surfactant.

The content of the polymer compound having fluorine atom-substituted aliphatic groups on its side chains is 0.01% to 20%, preferably 0.1% to 10% and more preferably 1% to 5%, with respect to the total solid content (mass) in the receptor layer.

In the method of forming an image of the present invention, imaging is achieved by superposing a heat-sensitive transfer sheet on a heat-sensitive transfer image-receiving sheet so that a thermal (heat) transfer layer of the heat-sensitive transfer sheet is in contact with a receptor layer of the heat-sensitive transfer image-receiving sheet and giving thermal energy in accordance with image signals given from a thermal head.

Specifically, an image-forming can be achieved by the similar manner to that as described in, for example, JP-A-2005-88545. In the present invention, a printing time is preferably less than 15 seconds, and more preferably in the range of 3 to 12 seconds, and further preferably 3 to 7 seconds, from the viewpoint of shortening a time taken until a consumer gets a print.

In order to accomplish the above-described printing time, a line speed at the time of printing is preferably 0.73 msec/line or less, and further preferably 0.65 msec/line or less. Further, from the viewpoint of improvement in transfer efficiency as one of speeding-up conditions, the maximum ultimate temperature of the thermal head at the time of printing is preferably in the range of 180° C. to 450° C., more preferably 200° C. to 450° C., and furthermore preferably 350° C. to 450° C.

The method of the present invention may be utilized for printers, copying machines and the like, which employs a heat-sensitive transfer recording system. As a means for providing heat energy in the thermal transfer, any of the conventionally known providing means may be used. For example, application of a heat energy of about 5 to 100 mJ/mm$^2$ by controlling recording time in a recording device such as a thermal printer (e.g. trade name: Video Printer VY-100, manufactured by Hitachi, Ltd.), sufficiently attains the expected result. Also, the heat-sensitive transfer image-receiving sheet for use in the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

The present invention can provide a method of forming an image having high image quality and no fluctuation depending on environmental conditions. Specifically the present invention can provide a method of forming an image that causes no generation of separation residue lines on the printing face by fusion of the heat-sensitive transfer sheet to the heat-sensitive transfer image-receiving sheet after printing and discontinuous separation of the heat-sensitive transfer sheet from the heat-sensitive transfer image-receiving sheet under a high-temperature high-humidity condition and white spots defect and that is excellent in gradation connection under a low-temperature low-humidity condition.

The present invention will be described in more detail based on the following examples, but the invention is not intended to be limited thereto. In the following Examples, the terms "part" and "%" are values by mass, unless they are indicated differently in particular.

EXAMPLES

Production of Heat-Sensitive Transfer Sheet

Samples 101 to 108 were prepared as follows.

A polyester film 6.0 μm in thickness (trade name: Diafoil K200E-6F, manufactured by MITSUBISHI POLYESTER FILM CORPORATION), that was subjected to an easy-adhesion-treatment on one surface of the film, was used as a substrate. The following back side-layer coating liquid was applied onto the substrate on the other surface that was not subjected to the easy-adhesion-treatment, so that the coating amount based on the solid content after drying would be 1 g/m$^2$. After drying, the coating liquid was cured by heat at 60° C.

Coating liquids, which will be detailed later, were used to form, onto the easily-adhesive layer coated surface of the thus-formed polyester film, individual thermal transfer layers in yellow, magenta and cyan, and a transferable protective layer laminate in area order by coating. In this way, a heat-sensitive transfer sheet was produced. The solid coating amount in each of the dye layers was set to 0.8 g/m$^2$.

In the formation of the transferable protective layer laminate, a releasing-liquid-coating liquid was coated, the resultant was dried, a protective-layer-coating liquid was coated thereon, the resultant was dried, and then an adhesive-layer-coating liquid was coated thereon.

Back Side Layer-Coating Liquid

| | |
|---|---|
| Acrylic polyol resin (trade name: ACRYDIC A-801, manufactured by Dainippon Ink and Chemicals, Incorporated) | 28.0 mass parts |
| Zinc stearate (trade name: SZ-2000, manufactured by Sakai Chemical Industry Co., Ltd.) | 0.45 mass part |
| Phosphate ester (trade name: PLYSURF A217, manufactured by Dai-ichi Kogyo Seiyaku Co., Ltd.) | 1.27 mass parts |
| Polyisocyanate (trade name: BURNOCK D-800, maanufactured by Dainippon Ink and Chemicals, Incorporated) | 8.5 mass parts |
| Methyl ethyl ketone/Toluene (2/1, at mass ratio) | 70 mass parts |

-continued

| Yellow-dye-layer-coating liquid | |
|---|---|
| Dye (Y-1) | 4.2 mass parts |
| Dye (Y-2) | 3.7 mass parts |
| Polyvinylacetal resin (trade name: DENKA BUTYRAL #6000-AS, manufactured by DENKI KAGAKU KOGYOU K. K.) | 6.0 mass parts |
| Polyvinylacetal resin (trade name: DENKA BUTYRAL #6000-CS, manufactured by DENKI KAGAKU KOGYOU K.K.) | 2.5 mass parts |
| Polymer compound having fluoride atom-subtituted aliphatic groups on its side chains or comparative compound (see Table 1 below) | 0.1 mass part |
| Matting agent (trade name: Flo-thene UF, manufactured by SUMITOMO PRECISION PRODUCTS Co., Ltd.) | 0.12 mass parts |
| Methyl ethyl ketone/Toluene (2/1, at mass ratio) | 85 mass parts |

Y-1

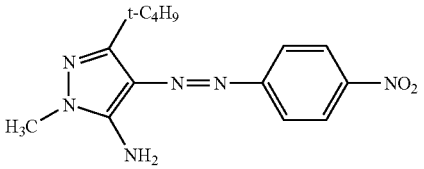

Y-2

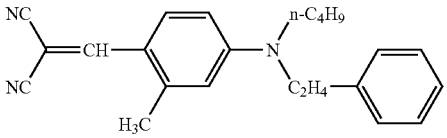

Magenta-Dye-Layer-Coating Liquid

| | |
|---|---|
| Dye (M-1) | 0.5 mass part |
| Dye (M-2) | 0.5 mass part |
| Dye (M-3) | 6.0 mass parts |
| Polyvinylacetal resin (trade name: DENKA BUTYRAL #6000-AS, manufactured by DENKI KAGAKU KOGYOU K. K.) | 7.0 mass parts |
| Polyvinylacetal resin (trade name: DENKA BUTYRAL #6000-CS, manufactured by DENKI KAGAKU KOGYOU K. K.) | 1.5 mass parts |
| Polymer compound having fluorine atom-substituted aliphatic groups on its side chains or comparative compound (see Table 1 below) | 0.1 mass part |
| Matting agent (trade name: Flo-thene, manufactured by SUMITOMO PRECISION PRODUCTS Co., Ltd.) | 0.12 mass past |
| Methyl ethyl ketone/Toluene (2/1, at mass ratio) | 85 mass parts |

M-1

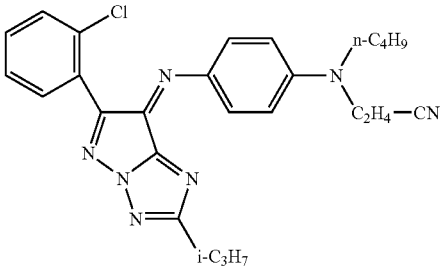

M-2

-continued

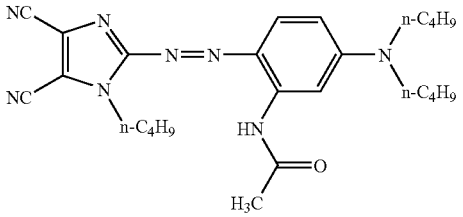

M-3

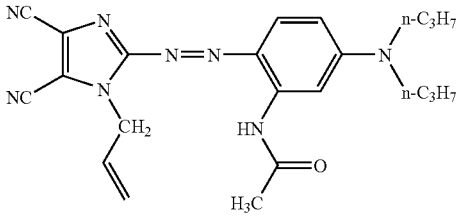

Cyan-Dye-Layer-Coating Liquid

| | |
|---|---|
| Dye (C-1) | 1.0 mass part |
| Dye (C-2) | 7.0 mass parts |
| Polyvinylacetal resin (trade name: DENKA BUTYRAL #6000-AS, manufactured by DENKI KAGAKU KOGYOU K. K.) | 7.5 mass parts |
| Polyvinylacetal resin (trade name: DENKA BUTYRAL #6000-CS, manufactured by DENKI KAGAKU KOGYOU K. K.) | 1.0 mass part |
| Polymer compound having fluorine atom-substituted aliphatic groups on its side chains or comparative compound (see Table 1 below) | 0.1 mass part |
| Matting agent (trade name: Flo-thene UF, manufactured by SUMITOMO PRECISION PRODUCTS Co., Ltd.) | 0.12 mass part |
| Methyl ethyl ketone/Toluene (2/1, at mass ratio) | 85 mass parts |

C-1

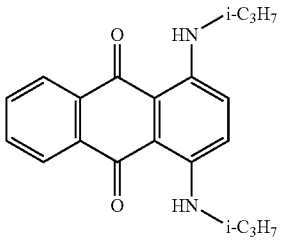

C-2

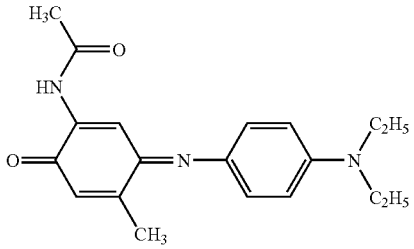

Transferable Protective Layer Laminate

On the polyester film coated with the dye layers as described above, coating liquids of a releasing layer, a protective layer and an adhesive layer each having the following composition were coated, to form a transferable protective layer laminate. Coating amounts of the releasing layer, the protective layer and the adhesive layer after drying were 0.5 g/m$^2$, 1.0 g/m$^2$ and 1.8 g/m$^2$, respectively.

Releasing-Layer-Coating Liquid

| | |
|---|---|
| Modified cellulose resin (trade name: L-30, manufactured by DAICEL CHEMICAL INDUSTRIES, LTD.) | 5.0 mass parts |
| Methyl ethyl ketone | 95.0 mass parts |
| Protective-layer-coating liquid | |
| Acrylic resin (trade name: DIANAL BR-100, manufactured by MITSUBISHI RAYON CO., LTD.) | 35 mass parts |
| Isopropanol | 75 mass parts |
| Adhesive-layer-coating liquid | |
| Acrylic resin (trade name: DIANAL BR-77, manufactured by MITSUBISHI RAYON CO., LTD.) | 25 mass parts |
| The following ultraviolet absorber UV-1 | 1.5 mass parts |
| The following ultraviolet absorber UV-2 | 1.5 mass parts |
| The following ultraviolet absorber UV-3 | 1.2 mass parts |
| The following ultraviolet absorber UV-4 | 0.8 mass part |
| Silicone resin fine particles (trade name: TOSPEARL 120, manufactured by MOMENTIVE Performance Materials Japan LLC.) | 0.06 mass part |
| Methyl ethyl ketone/toluene (2/1, at mass ratio) | 70 mass parts |

(UV-1)

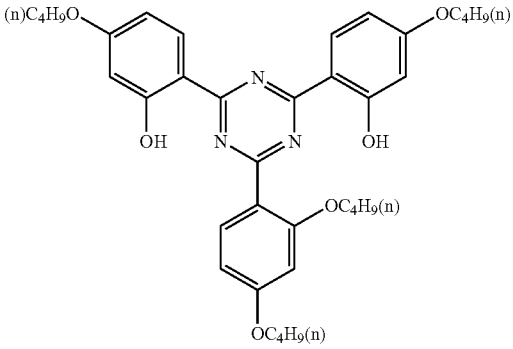

(UV-2)

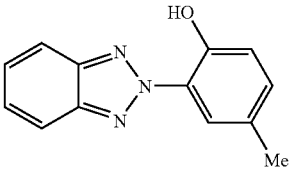

(UV-3)

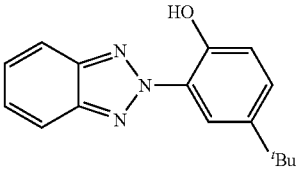

(UV-4)

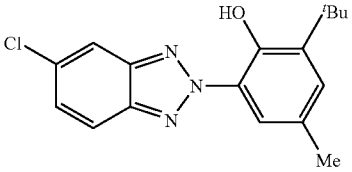

TABLE 1

Heat-sensitive transfer sheet

| Sample | Additive | Classification of compound |
|---|---|---|
| 101 | None | — |
| 102 | Megafac F-472SF, trade name, manufactured by Dainippon Ink and Chemicals, Inc. | Polymer compound having fluorine atom-substituted aliphatic groups on its side chains, nonionic, water-soluble |
| 103 | Megafac F-479, trade name, manufactured by Dainippon Ink and Chemicals, Inc. | Polymer compound having fluorine atom-substituted aliphatic groups on its side chains, nonionic, water-soluble |
| 104 | Megafac F-483, trade name, manufactured by Dainippon Ink and Chemicals, Inc. | Polymer compound having fluorine atom-substituted aliphatic groups on its side chains, nonionic, water-insoluble |
| 105 | Megafac F-477, trade name, manufactured by Dainippon Ink and Chemicals, Inc. | Polymer compound having fluorine atom-substituted aliphatic groups on its side chains, nonionic, water-soluble |
| 106 | Zonyl FSA, trade name, manufactured by Du Pont Co. | Lithium salt of fluorocarboxylic acid, anionic, water-soluble |
| 107 | Polyester-modified silicone, trade name, Shin-Etsu Chemical Co., Ltd. | Polyester-modified silicone resin |
| 108 | Diaromer SP-712, trade name, manufactured by Dainichiseika Color & Chemicals Mfg. Co., Ltd. | Silicone resin |

(Preparation of Heat-Sensitive Transfer Image-Receiving Sheet)

Samples 201 to 207 were prepared as follows.

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, and the receptor layer each having the following composition were multilayer-coated on the gelatin undercoat layer, in the state that the subbing layer, the heat insulation layer, and the receptor layer were laminated in this order from the side of the support, by a method illustrated in FIG. 9 in U.S. Pat. No. 2,761,791. The coating was performed so that coating amounts of the subbing layer, the heat insulation layer, and the receptor layer after drying would be 6.5 g/m$^2$, 9.0 g/m$^2$ and 5.5 g/m$^2$, respectively. The following compositions are expressed by mass as a solid content.

Receptor Layer

| | |
|---|---|
| Latex polymer (Table 2) | 25.0 mass parts |
| Additive (Table 2) | 1.0 mass part |
| Gelatin (10% solution) | 3.0 mass parts |
| Sodium salt of 4,6-dichloro-2-hydroxy-1,3,5-triazine | 0.01 mass part |
| Surfactant F-2 | 0.36 mass part |
| Heat insulation layer | |
| Hollow latex polymer (trade name: MH5055, manufactured by ZEON CORPORATION) | 65.0 mass parts |
| Gelatin (10% solution) | 30.0 mass parts |
| Sodium salt of 4,6-dichloro-2-hydroxy-1,3,5-triazine | 0.1 mass part |
| Subbing layer | |
| Polyvinyl alcohol (trade name: POVAL PVA 205, manufactured by KURARAY CO., LTD.) | 7.0 mass parts |
| Styrene butadiene rubber latex (trade name: SN-307, manufactured by NIPPON A & L INC) | 60.0 mass parts |
| Surfactant F-1 | 0.03 mass part |

(EW-1)

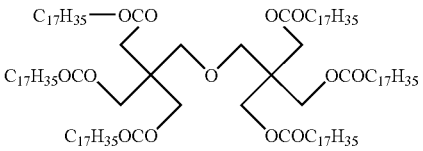

-continued (F-1)

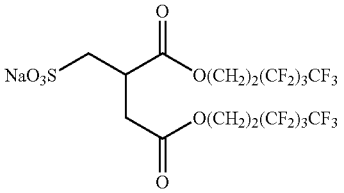

F-2

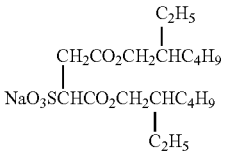

TABLE 2

Heat-sensitive transfer image-receiving sheet

| Sample | Latex polymer | Tg | Additive |
|---|---|---|---|
| 201 | VINYBRAN 900, trade name, manufactured by Nisshin Chemical Industry Co., Ltd. | 70° C. | None |
| 202 | VINYBRAN 609, trade name, manufactured by Nisshin Chemical Industry Co., Ltd. | 46° C. | None |
| 203 | VINYBRAN 609, trade name, manufactured by Nisshin Chemical Industry Co., Ltd. | 46° C. | EW-1 |
| 204 | VINYBRAN 609, trade name, manufactured by Nisshin Chemical Industry Co., Ltd. | 46° C. | Megafac F-472SF, trade name, manufactured by Dainippon Ink and Chemicals, Inc. |
| 205 | VINYBRAN 276, trade name, manufactured by Nisshin Chemical Industry Co., Ltd. | 33° C. | None |
| 206 | VYLONAL MD-1100, trade name, manufactured by Toyobo Co., Ltd. | 40° C. | None |

TABLE 2-continued

| Heat-sensitive transfer image-receiving sheet | | | |
|---|---|---|---|
| Sample | Latex polymer | Tg | Additive |
| 207 | VYLONAL MD-1100, trade name, manufactured by Toyobo Co., Ltd. | 40° C. | Megafac F-479, trade name, manufactured by Dainippon Ink and Chemicals, Inc. |

The heat-sensitive transfer image-receiving sheet described in the following patent Document was also prepared.

| | | |
|---|---|---|
| Sample 108 | Heat-sensitive transfer image-receiving sheet 5 described in the Example of JP-A-2006-88691 | |
| | Latex polymer: | VYLONAL MD-1200 Trade name, manufactured by Toyobo Co., Ltd. (Tg: 67° C.) |
| | Additive: | FC-4430, trade name, manufactured by Sumitomo 3M Ltd. |

(Evaluation)

Fujifilm thermal photoprinter ASK-2000L (trade name, manufactured by FUJIFILM CORPORATION) was used as a printer for the evaluation of image-forming methods. The heat-sensitive transfer sheet, the heat-sensitive transfer image-receiving sheet, and the printer were left under the following environmental conditions for 24 hours or longer; an image of 127 mm×89 mm in size was output continuously on ten sheets under the same conditions; the separation residue, fusion or white spots of the output image were evaluated according to the following criteria. Two images of each of a person (indoor), a person (outdoor), a person (wedding ceremony (in wedding dress)), a landscape, a still life, a solid black image, were evaluated by ten viewers by organoleptic evaluation, and the average value of the criteria was determined.

Environmental Conditions

A: High-temperature high-humidity condition, temperature: 35° C., humidity: 80%

B: Low-temperature low-humidity condition, temperature: 10° C., humidity: 20%

C: Standard-temperature normal-humidity condition, temperature: 25° C., humidity: 55%

(1) Evaluation Criteria of Separation Residue and Fusion Under the High-Temperature High-Humidity Condition A 5: No separation residue was detected by visual observation.

4: Some separation residue was detected but only to the degree allowing appreciation of image without difficulty.

3: Separation residue prohibited appreciation of image, depending on the kind of image.

2: Separation residue prohibited appreciation of image observed regardless of the kind of image.

1: Fusion of heat-sensitive transfer sheet and heat-sensitive transfer image-receiving sheet was observed.

(2) Evaluation Criteria of White Spots Defect Under the Low-Temperature Low-Humidity Condition B 5: No white spot was detected.

4: Some white spots were detected but only to the degree allowing appreciation of image without difficulty.

3: White spots prohibited appreciation of image, depending on the kind of image.

2: White spots prohibited appreciation of image regardless of the kind of image.

1: Many white spots were detected, apparently resulting in decrease in overall image density.

(3) Evaluation Criteria of Gradation in Highlighted Region Under the Standard-Temperature Normal-Humidity Condition C 5: Excellent in gradation and excellent in texture in highlighted region.

4: Highlight tone was attenuated only to the degree allowing appreciation of image without difficulty.

3: Highlight tone was attenuated, disturbing appreciation, depending on density of high-lighted region.

2: Highlight tone was greatly attenuated in high-lighted region at high density, disturbing appreciation.

1: Highlight tone was significantly attenuated, making white area gray in appearance because of high density of white.

TABLE 3

(Evaluation result)

| Experimental No. | Heat-sensitive transfer sheet No. | Heat-sensitive transfer image-receiving sheet No. | Evaluation criterion of separation residue and fusion under high-temperature high-humidity condition | Evaluation criterion of white spots defect under low-temperature low-humidity condition | Evaluation criterion of gradation in highlighted region under standard-temperature standard-pressure condition | Remarks |
|---|---|---|---|---|---|---|
| 1 | 101 | 201 | 3.1 | 1.3 | 1.2 | Comparative example |
| 2 | 102 | 201 | 4.7 | 1.2 | 4.2 | Comparative example |

TABLE 3-continued

| Experimental No. | Heat-sensitive transfer sheet No. | Heat-sensitive transfer image-receiving sheet No. | (Evaluation result) Evaluation criterion of separation residue and fusion under high-temperature high-humidity condition | Evaluation criterion of white spots defect under low-temperature low-humidity condition | Evaluation criterion of gradation in highlighted region under standard-temperature standard-pressure condition | Remarks |
|---|---|---|---|---|---|---|
| 3 | 102 | 202 | 4.1 | 4.2 | 4.1 | This invention |
| 4 | 102 | 203 | 4.2 | 4.1 | 4.1 | This invention |
| 5 | 102 | 204 | 4.9 | 4.8 | 4.8 | This invention |
| 6 | 102 | 205 | 4.1 | 4.3 | 4.0 | This invention |
| 7 | 102 | 206 | 4.1 | 4.0 | 4.1 | This invention |
| 8 | 102 | 207 | 4.4 | 4.7 | 4.9 | This invention |
| 9 | 101 | 204 | 1.2 | 4.7 | 1.8 | Comparative example |
| 10 | 103 | 204 | 4.9 | 4.8 | 4.6 | This invention |
| 11 | 104 | 204 | 4.7 | 4.8 | 4.7 | This invention |
| 12 | 105 | 204 | 4.6 | 4.7 | 4.6 | This invention |
| 13 | 106 | 204 | 1.7 | 4.4 | 1.8 | Comparative example |
| 14 | 107 | 204 | 2.9 | 4.6 | 2.7 | Comparative example |
| 15 | 108 | 204 | 3.3 | 4.5 | 3.1 | Comparative example |
| 16 | 105 | 208 | 3.4 | 2.1 | 2.7 | Comparative example |

As obvious from Table 3 above, the image-forming method of the present invention using of a specific heat-sensitive transfer sheet and a specific heat-sensitive transfer image-receiving sheet resulted in reduction of separation residues and fusion, white spots defects, and also attenuation of high-light tone and gave an image excellent in gradation connection. Thus, the method of the present invention is thus distinctively more advantageous than the method in Comparative Examples.

Having described our invention as related to the present embodiments, it is our intention that the present invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-016776 filed in Japan on Jan. 28, 2008, which is entirely herein incorporated by reference.

What is claimed is:

1. A method of forming an image, comprising the steps of:

superposing a heat-sensitive transfer sheet on a heat-sensitive transfer image-receiving sheet, and applying thermal energy from a side of a heat-resistant lubricating layer described below of the heat-sensitive transfer sheet, to form a thermally transferred image, wherein the heat-sensitive transfer sheet comprises a substrate, a thermal transfer layer containing a thermally transferable dye and a resin on one face of the substrate, and the heat-resistant lubricating layer on the other face of the substrate, wherein the heat-sensitive transfer image-receiving sheet comprise a support, and at least one heat insulation layer and at least one receptor layer on the support in this order, wherein the thermal transfer layer contains a polymer compound having fluorine atom-substituted aliphatic groups on its side chains, and wherein the receptor layer contains a latex polymer having a glass transition temperature (Tg) of 20° C. or higher and 60° C. or lower.

2. The method of forming an image according to claim 1, wherein the polymer compound having fluorine atom-substituted aliphatic groups on its side chains is nonionic.

3. The method of forming an image according to claim 1, wherein the polymer compound having fluorine atom-substituted aliphatic groups on its side chains is water-soluble.

4. The method of forming an image according to claim 1, wherein the heat insulation layer contains hollow polymer particles.

5. The method of forming an image according to claim 1, wherein the receptor layer contains a polymer compound having fluorine atom-substituted aliphatic groups on its side chains.

6. The method of forming an image according to claim 5, wherein the polymer compound having fluorine atom-substituted aliphatic groups on its side chains contained in the receptor layer is nonionic.

7. The method of forming an image according to claim 5, wherein the polymer compound having fluorine atom-substituted aliphatic groups on its side chains contained in the receptor layer is water-soluble.

8. The method of forming an image according to claim 1, wherein the receptor layer contains water-soluble polymer particles.

* * * * *